US006652049B1

(12) United States Patent
Tyner

(10) Patent No.: US 6,652,049 B1
(45) Date of Patent: Nov. 25, 2003

(54) STORAGE AND DISPLAY DOOR

(76) Inventor: Scott Tyner, 3180 NE. 48$^{th}$ Ct., #303, Lighthouse Point, FL (US) 33064

( * ) Notice: Subject to any disclaimer, the term of this patent is extended or adjusted under 35 U.S.C. 154(b) by 0 days.

(21) Appl. No.: 08/614,739

(22) Filed: Mar. 13, 1996

(51) Int. Cl.$^{7}$ ..... E06B 1/00
(52) U.S. Cl. ..... 312/321.5
(58) Field of Search ..... 312/237, 321.5, 312/326, 329, 291, 405.1, 226, 227

(56) References Cited

U.S. PATENT DOCUMENTS

| | | | | | |
|---|---|---|---|---|---|
| 1,035,015 | A | * | 8/1912 | Johnson | 312/114 |
| 1,322,454 | A | * | 11/1919 | Kendall | 312/224 |
| 1,673,291 | A | * | 6/1928 | Matchette | 232/43.4 |
| 2,575,530 | A | * | 11/1951 | Reid | 312/225 |
| 2,808,610 | A | * | 10/1957 | Minor | 16/365 |
| 3,533,671 | A | * | 10/1970 | Huber | 312/227 |
| 3,822,925 | A | * | 7/1974 | Osroff | 312/242 |
| 4,792,050 | A | * | 12/1988 | Allen | 211/64 |
| 6,457,278 | B1 | * | 10/2002 | Fleming | 52/37 |

FOREIGN PATENT DOCUMENTS

| | | | | |
|---|---|---|---|---|
| GB | 430060 | * | 6/1935 | 312/321.5 |
| GB | 491599 | * | 9/1938 | 312/321.5 |

* cited by examiner

*Primary Examiner*—Janet M. Wilkens
(74) *Attorney, Agent, or Firm*—Christopher & Weisberg, P.A.

(57) ABSTRACT

A door having storage and display areas provided therein. The door includes a back wall, side walls, and a shelf which cooperates to define separate storage spaces therein. The storage spaces may be encloseable by a door included therein.

11 Claims, 2 Drawing Sheets

STORAGE AND DISPLAY DOOR

FIELD OF THE INVENTION

The present invention is generally related to doors. More specifically, the present invention relates to doors having a storage space therein. Even more particularly, the present invention relates to doors having a displayable storage-space formed therein.

PRIOR ART

Prior to the invention disclosed herein there have been taught many differently configured closet and cabinet doors. These doors have generally been utilized to environmentally separate the interior of the closet or cabinet from the surrounding space. It is well known that by employing a door, items stored within the closet or cabinet are blocked from view when the door is closed.

Heretofore, there has additionally been taught, as in U.S. Pat. No. 3,822,955 to Osroff, a storage unit which is houseable within a door. More particularly, Osroff teaches the inclusion of a removable storage container mounted within a standard door of small thickness. Access to the storage container is achieved through the use of a second door disposed therein. The space provided by the Osroff invention is relatively small and is limited by the actual width of the door itself. Thus, the size and configuration of items that may be stored therein is limited. Additionally, there is not provided in any of the heretofore known prior art an open area in a door which would allow items placed therein to be viewed.

Thus, what is needed in the art is a door having a substantially large storage area capable of serving as a display for items placed therein. Additionally, what is needed is a door having a storage area that may have an open configuration or a closed configuration.

SUMMARY OF THE INVENTION

The present invention provides a storage display door comprising:

(a) a substantially vertically oriented back wall, the back wall having a front surface, a back surface, a pair of side edges, a top edge and a bottom edge;

(b) a pair of substantially vertically oriented side walls, each of the pair of side walls having a front edge and a back edge, each of the pair of walls mounted to a corresponding side edge of the back wall and extending forwardly from the back wall;

(c) a substantially horizontally aligned shelf mounted to and extending forwardly from the back wall;

(d) a substantially horizontal aligned bottom wall having a top surface and a bottom surface, the bottom wall mounted to and extending forwardly from the front surface of the back wall, wherein the shelf, the back wall, each of the pair of side walls, and the bottom wall define a first storage area;

(e) a substantially horizontal aligned top wall mounted at and extending forwardly at the top edge of the back wall, wherein the top wall, the back wall, each of the pair of side walls, and the shelf define a second storage area.

The present invention is directed to a storage display door. The door generally includes a substantially vertically oriented back wall, two forwardly extending side walls, and a shelf or shelves mounted to and forwardly extending from the back wall.

Items may-be-seated upon the shelf or shelves disposed in the door so that they may be viewed by passers-by. The door additionally may include a substantially horizontally oriented bottom wall forwardly extending from the front surface at the bottom edge of the back wall. The shelf, bottom wall, back wall, and side walls cooperate to define a first storage area.

A top wall may be mounted to the front surface of the back wall and extend forwardly therefrom. The top wall, back wall, shelf, and the pair of side walls cooperated to define a second storage space or area.

A door may be hingedly mounted to a front portion of one of the side walls to provide means for enclosing the second storage area. Additionally, a mirror may be mounted to the front surface of the back wall, generally above the shelf extending upwardly towards the top of the door.

Also, a downwardly extending shoulder may be included in the present invention to preclude air drafts from passing under the display door. The top wall may also serve such a purpose.

The present invention will be more clearly understood with reference to the accompanying drawings. Through the various figures, like reference numerals refer to like parts in which:

DETAILED DESCRIPTION OF THE PREFERRED EMBODIMENT

Figure 1:
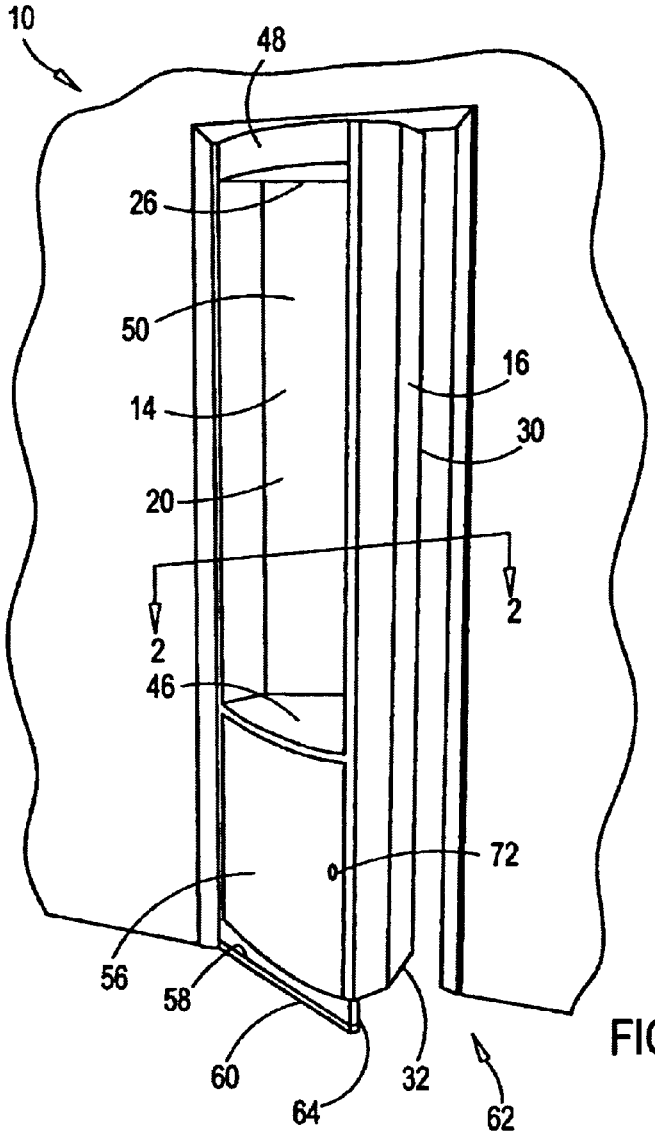
FIG. 1 is a perspective view of a door in accordance with the present invention.
Figure 2:
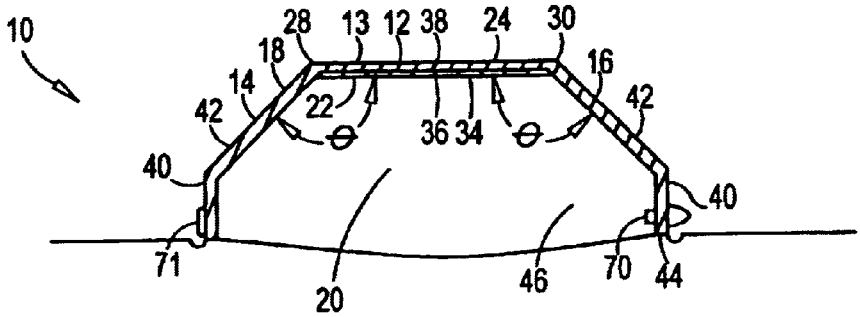
FIG. 2 is a cross-sectional view of the door of FIG. 1 taken across 2—2.

As shown in FIG. 1, there is depicted therein a storage and display door in a accordance with the present invention, generally shown at 10. The door 10 has a substantially vertically oriented elongated back wall 12. A pair of substantially vertically oriented side walls 14, 16 extend forwardly from the back wall 12 and cooperate therewith to define the rear portion 18 of the door 10.

The back wall 12 and the forwardly extending side walls 14, 16 may be formed from wood, plastic or any other durable strong material. It is to be appreciated that the back wall, 12 and the forwardly extending side walls 14,16 define a space therebetween. This space serves as a general storage area 20 of the present invention.

The back wall 12 of the door 10 in accordance with the present invention has a front surface 22, and a rear surface 24, a top edge 26, two side edges 28, 30 and a bottom edge 32.

The back wall 12 serves as the rear portion 18 of the door 10. A mirror 34 having a front surface 36 and a rear reflective surface 38 is envisioned as mounted to the front surface 22 of the back wall 12 of the door 10. The mirror 34 may have any configuration such that it is mountable upon the front surface 22 of the back wall 12. The mirror 34 may be mounted thereupon via glue, two sided tape, brackets, or any other well-known means for mounting.

Each of the side walls 14, 16 has a front portion 40 and a back portion 42 and may be integrally formed with the back wall 12. Alternatively, and as pictured in FIG. 4, the back wall 12 and cooperating side walls 14, 16 may have a substantially arcuate configuration. Alternatively, each side wall 14, 16 may be produced separately from the back wall 12 and be attached at the back portion 42 to opposite side edges 28, 30 of the back wall via glue, screws, brackets or the like. Because the joint created from mounting the side walls 14, 16 to the back wall 12 is visible to those who see the rear 13 of the door, it is preferable to use glue or screws to attach the respective side walls thereto.

Figure 4:
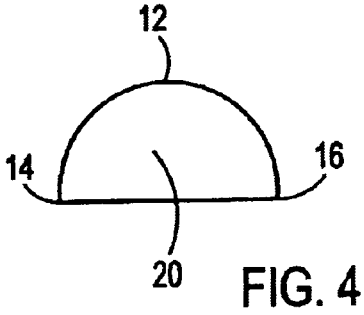
FIG. 4 is a cross-sectional top-down view of an alternative configuration for a door in accordance with the present invention.

The rear portion 42 of each of the side walls 14, 16 is attached to the back wall 12 at a substantially obtuse angle 0. The angle 0 preferably ranges from 91° to 160°. However, and as depicted in FIG. 4, the back wall 12 and side walls 14, 16 may have a substantially constant radius of curvature.

Each side wall 14, 16 includes a front portion 40. The front portion 40 of each respective corresponding side wall is aligned substantially normal the back wall 12. By employing side walls 14, 16 having front portions 40 and back portions 42, the size of the storage space provided by the cooperation of the back wall 12 and the side walls 14, 16 approaches a maximum.

Additionally, it is necessary for the front portion 40 of each side wall 14, 16 to be configured to allow the door 10 of the present invention to be opened and shut. If the front portions 40 are too long, the door 10 will not function properly. As such, it is envisioned that each of the front portions 40 of the side walls 14, 16 will have a length about equal to or less than the width of the door frame within which the door slidably rotatively seats.

Each side wall 14, 16 preferably is substantially equal in height to the back wall 12. However, the walls may be differing heights as long as the door 10 may open and close within the door frame 44.

A shelf 46 is mounted to and extends forwardly from the front surface 22 of the back wall 12. The shelf 46 may, additionally be mounted to each of the side walls 14, 16 to provide increased stability of the shelf 42. Although the preferred embodiment of the present invention only includes one shelf 46, the present invention may have a plurality of horizontally disposed shelves depending upon the user.

The door 10 of the preferred embodiment herein further includes a top wall 48. The top wall 48 is mounted near the top edge 26 of the back wall 12 and extends forwardly therefrom. The top wall 48 contacts each of the side walls 14, 16 at both their back 42 and front 40 portions. The top wall 48, back wall 12, side walls 14, 16 and shelf 46 cooperate to define a first storage space 50. The volume of the first space 50 is determined by the location of the shelf 46. The shelf 46 may be mounted to the front surface 22 of the back wall 12 substantially anywhere between the top wall 48 and a bottom wall 52, which will be further discussed hereinbelow.

As such, the size of the first storage space 50 may be configurable depending upon what a user intends upon seating upon the shelf 46. The height at which the shelf is mounted to the front surface 22 of the back wall 12 may be determined upon construction of the door 10.

Figure 3:
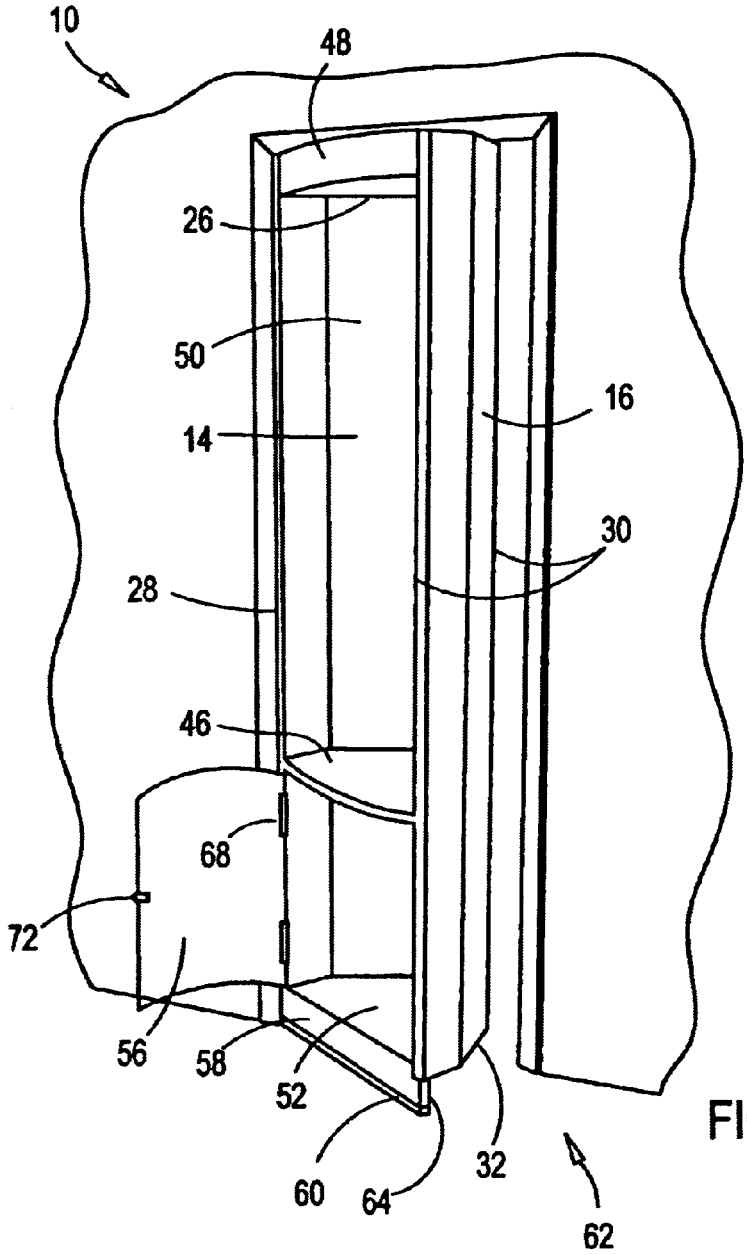
FIG. 3 is a perspective view of the door of FIG. 1 with the first storage area in an open configuration.

The door 10 in accordance with the present invention additionally includes a bottom wall 52 as shown in FIG. 3. The bottom wall 52 is mounted to the front surface 22 of the back wall 12 at the bottom edge 32 thereof. The bottom wall 52 and the top wall 48 may be formed from the same material as the back wall 12. Alternatively, the bottom wall 52 and the top wall 48 may be formed from a different material as long as it is durable and strong.

The shelf 46, back wall 12, side walls 14, 16 and bottom wall 52 cooperate to define a second storage space 54 area. As pictured in the figures, the second storage space 54 is smaller than the first storage space 50. The sizes of each of the storage spaces may be configured differently by the placement of the shelf 46 in the door 10.

The second storage space 54 may be enclosed via a door 56 mounted to the front portion 40 of one of the side walls 14, 16. The door 56 is preferably mounted via hinges 68 attached to one of the side walls 14, 16, at the front portion 40 thereof. It is additionally preferable to utilize spring biased hinges for such a purpose to bias the door 56 into a closed configuration.

Alternatively, the door 56 may be mounted at the back wall 12. As such, the second storage area 54 is accessible from the rear of the door 12 and not the front. To accomplish this, an aperture is formed in the back wall such that a door may be hingedly mounted thereat. In such an embodiment, from the front of the door, the second storage area 54 would not be accessible. A front wall would replace the door 56 of the preferred embodiment. This provides a more secure storage area that is not accessible to those passing in front of the door 10

Also, the second storage space 54 may contain a set of slide out drawers or the like. It is well-known that slide out drawers require the installation of slidable means for mounting.

In the preferred embodiment, the door is mounted to a door frame via hinges 71 and includes a downwardly directed shoulder 58. Generally, doors do not extend all the way to the floor because of the variability of the doors size depending upon temperature, humidity, etc. As such, the shoulder 58 of the present invention is included to preclude passage of light and air from an area exterior the closet or other space to the area located anterior the door. Because the shoulder 58 may occasionally contact the floor 62, a guard 60 is placed at the bottom edge 64 thereof. The guard, may be formed from rubber, vinyl, or some other material that will not damage the top surface of the floor 62 which it may slide across.

Apertures may be formed in the back wall 12 of the door to allow electrical wiring to be included therein allowing the placement of electrical devices, such as a radio or compact disc player in one of the storage areas. Additionally, a small handle 70 may be included on one of the side walls 14, 16 to allow for easier opening of the door 10. Handles, and means for attaching them to a door are well known in the art.

Beside placing items on the shelf, means for mounting fire arms may be disposed on the front surface 22 of the back wall 12. As such, the door serves additionally as a gun display. Any well known means for mounting guns may be included therein.

Although the invention has been described-with reference to particular embodiments, it is to be understood that these embodiments are to be illustrative of the application of the principles of the present invention. Numerous modification may be made therein and other arrangements may be devised without departing from the scope of the invention.

Having this said, what is claimed is:

1. A swingable storage display door rotatably mountable to a door frame, the display door comprising:

(a) a substantially vertically oriented back wall, the back wall having a front surface, a back surface, a pair of side edges, a top edge and a bottom edge;

(b) a pair of substantially vertically oriented side walls, each of the pair of side walls having a front edge and a back edge, each of the pair of walls mounted to the back wall and extending forwardly from the back wall;

(c) a substantially horizontally aligned shelf mounted to and extending from the back (d) a substantially horizontal aligned bottom wall having a top surface and a bottom surface, the bottom wall mounted to and extending forwardly from the front surface of the back wall, wherein the shelf, the back wall, each of the pair of side walls, and the bottom wall define a first storage area; and (e) a substantially horizontal aligned top wall mounted at and extending forwardly from the top edge of the back wall, wherein the top wall, the back wall, each of the pair of side walls, and the shelf define a second storage area, wherein one of the side walls is rotatable mounted to the door frame.

2. The storage display door of claim 1 wherein the top wall has a thickness greater than that of the shelf.

3. The storage display door of claim 1 further including a mirror mounted to the front surface of the back wall.

4. The storage display door of claim 1 further including a door, hingedly mounted to the front portion of one of the pair of forwardly extending side walls such that the first storage area is enclosable.

5. The storage display door of claim 1 further including a shoulder mounted at the bottom surface of the bottom wall and extending downwardly therefrom.

6. The storage display door of claim 1 further comprising at least one additional horizontally aligned shelf mounted to and extending from the back wall.

7. A swingable storage display door unit rotatably mounted to a door frame, the door unit comprising:

(a) a substantially vertically aligned back wall, the back wall having a front surface, a back surface, a pair of side edges, a top edge and a bottom edge;

(b) a pair of substantially vertically aligned side walls, each of the pair of side walls having a front edge and a back edge each of the pair of side walls mounted to the back wall and extending forwardly from the back wall;

(c) a substantially horizontally aligned shelf mounted to and extending from the back wall;

(d) a substantially horizontal aligned bottom wall having a top surface and a bottom surface, the bottom wall mounted to and extending forwardly from the front surface of the back wall, and a substantially vertically oriented front wall, wherein the shelf, the back wall, each of the pair of side walls, the bottom wall and the front wall define an enclosed, first area; and (e) a substantially horizontal aligned top wall mounted at and extending forwardly from the top edge of the back wall, wherein the top wall, the back wall, each of the pair of side walls, and the shelf define an open second area, wherein one of the side walls is rotatably mounted to the door frame.

8. The storage display door unit of claim 7 further including a mirror mounted to the front surface of the back wall.

9. The storage display door unit of claim 7 further comprising one or more additional horizontally aligned shelves mounted to and extending from the back wall.

10. A swingable storage display door assembly comprising:

a door frame; and a door comprising:

a substantially vertically oriented back wall, the back wall having a front surface, a back surface, a pair of side edges, a top edge and a bottom edge;

a pair of substantially vertically oriented side walls, each of the pair of side walls having a front edge and a back edge, each of the pair of walls mounted to the back wall and extending forwardly from the back wall;

a substantially horizontally aligned shelf mounted to and extending from the back wall;

a substantially horizontal aligned bottom wall having a top surface and a bottom surface, the bottom wall mounted to and extending forwardly from the front surface of the back wall, wherein the shelf, the back wall, each of the pair of side walls, and the bottom wall define a first storage area; and a substantially horizontal aligned top wall mounted at and extending forwardly from the top edge of the back wall, wherein the top wall, the back wall, each of the pair of side walls, and the shelf define a second storage area, wherein one of the side walls is rotatably mounted to the door frame.

11. A method of fabricating a swingable storage display door rotatably mountable to a door frame, the method comprising:

providing a substantially vertically oriented back wall, the back wall having a front surface, a back surface, a pair of side edges, a top edge and a bottom edge;

mounting to and extending forwardly from the back wall, a pair of substantially vertically oriented side walls, each of the pair of side walls having a front edge and a back edge, wherein one of the side walls is rotatably mounted to the door frame;

mounting to and extending from the back wall, a substantially horizontally aligned shelf;

mounting to and extending forwardly from the front surface of the back wall, a substantially horizontal aligned bottom wall having a top surface and a bottom surface, wherein the shelf, the back wall, each of the pair of side walls, and the bottom wall define a first storage area; and mounting to and extending forwardly from the front surface of the back wall, a substantially horizontal aligned top wall, wherein the top wall, the back wall, each of the pair of side walls, and the shelf define a second storage area.

* * * * *

UNITED STATES PATENT AND TRADEMARK OFFICE

CERTIFICATE OF CORRECTION

PATENT NO. : 6,652,049 B1
DATED : November 25, 2003
INVENTOR(S) : Scott Tyner

It is certified that error appears in the above-identified patent and that said Letters Patent is hereby corrected as shown below:

Column 5,
Line 4, after "back", please insert -- wall --.

Signed and Sealed this

Fifteenth Day of February, 2005

JON W. DUDAS
*Director of the United States Patent and Trademark Office*